United States Patent [19]

Ladd

[11] 4,009,674

[45] Mar. 1, 1977

[54] METHOD OF STACKING ROLLS

[75] Inventor: Charles Ray Ladd, Washington, N.C.

[73] Assignee: Coats & Clark, Inc., Jamesville, N.C.

[22] Filed: June 25, 1975

[21] Appl. No.: 590,043

[52] U.S. Cl. ..... 112/265; 112/104; 112/113; 112/121.26; 112/152; 112/203; 242/55; 242/66

[51] Int. Cl.[2] ..... D05B 3/12

[58] Field of Search ..... 112/262, 265, 2, 121.26, 112/104, 105, 106, 113, 121.27, 137, 203, 152, 158 R; 242/55, 66

[56] References Cited

UNITED STATES PATENTS

| | | | |
|---|---|---|---|
| 3,299,843 | 1/1967 | Alexeff | 112/262 |
| 3,685,474 | 8/1972 | Frohlich et al. | 112/265 |
| 3,901,173 | 8/1975 | Ellington et al. | 112/262 |
| 3,911,842 | 10/1975 | Zawick | 112/265 |

*Primary Examiner*—G. V. Larkin

*Attorney, Agent, or Firm*—Burgess Ryan and Wayne

[57] ABSTRACT

This invention relates to a method and apparatus for handling tape, such as knit or woven tape employed in the manufacture of zippers, and is more particularly directed to an improved apparatus and method for reeling and dereeling tape.

7 Claims, 11 Drawing Figures

METHOD OF STACKING ROLLS

In conventional techniques for handling tape, between its formation on a knitting or weaving machine and its application to a sewing machine for the formation of zippers, it has been the practice in the past to assemble the tape in loose form in a container at some stage during the process.

Considering first knitting machines, conventional knitting machines for the formation of tapes may have working widths of, for example, 168 inches, and such machines may thus be employed to form up to about 240 narrow tapes simultaneously. The term "narrow" is herein employed to tapes from about ¼ in width to several inches in width.

In the formation of narrow tapes in such a knitting machine, it is conventional to wind the tapes simultaneously on a number of cylinders. For example, in a machine producing 240 tapes, groups of 60 tapes each may be simultaneously wound on four cylinders. The winding of the tapes in such groups facilitated the later handling of the rolls of tape. The rolls of tape wound in this manner were generally spaced apart so that they provided no lateral support for each other. As a consequence, it was considered necessary to provide a means for preventing lateral collapse of the rolls. For this purpose, the knitting machine included means for stitching adjacent tapes together, so that lateral support was provided between the tapes of each group of tapes wound on a cylinder.

Since the tapes were sewn together, it was necessary to subsequently separate the tapes from the rolls prior to feeding them to a knitting machine. In some cases, this was done manually or automatically by pulling the outermost tape from a group of tapes, while dereeling it into a box in loose form. As a result, it was necessary to provide a separate box for receiving tape on each roll. Since the tape in the box was in loose form, its volume was increased and hence it was necessary to limit the length of tape that was wound in a roll, for example, to several hundred yards of tape. In an operation of this type, it was not considered practical to feed the tape directly from the knitting machine in loose form to a large number of separate boxes.

A technique has also been suggested, wherein the thread interconnecting the tapes is of a material such that it may be chemically removed. The use of this technique, of course, required a further step of chemically dissolving the thread in order to separate the rolls of tape. In any event, the procedures for reeling such tapes in the past have always required some technique for separating the wound tapes so that they could be further processed in a sewing machine.

Weaving machines employed for the production of narrow tapes typically do not produce as many tapes as a knitting machine, and consequently when weaving machines were employed for the production of tapes, it was conventional to directly feed the woven tapes from the loom to boxes in loose form for later use. As in the case of the knitting machines, this, of course, produces a space problem since loose tape occupies a considerable space. Further, as in the case of knitting machines, there is a limit to the length of tape that can be placed in each box, and due to the required space, lengths of only several hundred yards are fed into each box.

In the use of the tape, for example, in the production of zippers, tape from two boxes of loose-filled tape were fed to the sewing machine. Since the length of tape in each box was limited, frequent splicing of tape was necessary. In addition, tangling of the tape, as it proceeded from the loose-filled boxes, was a problem, and it was also necessary to provide a separate means for insuring that the tape had the proper tension when it was fed to the sewing machine.

In general, the above practices illustrate that procedures involving the production of multiple tapes on a knitting or weaving machine and the use of such multiple produced tapes, conventionally involved the intermediate step of storing the tape in loose form in boxes or the like, whereby a storage problem was created in view of the required large volume for storing tape in loose form, problems were involved in the use tape stored in loose form, and, in the case of knitting machines, additional steps were required to separate long rolls of tape for storage in loose form in the boxes.

The invention is directed to a method and apparatus for overcoming the above problems. Briefly stated, in accordance with one embodiment of the invention, tape from a conventional knitting or weaving machine is directly wound in spaced-apart rolls on the cylinder of length convenient for handling, and no lateral support is provided for adjacent tapes wound on the cylinder. Following the completion of the winding step, slotted discs are inserted between adjacent tapes on the cylinder, and if storage of the tapes for later use is required, the rolls of tape are stored in this form too.

In the use of the tapes wound on the cylinder, for example, for the production of zippers, a pair of cylinders having multiple rolls of tape wound thereon and separated by discs, are placed on horizontal tables with the axes of the cylinders being disposed vertically. Tape from the top rolls of the cylinders on the tables is fed to a sewing machine for the production of zippers. Each of the tables is provided with a rotational drive, for example, a separately controllable electric motor, and the motors are driven at a speed to maintain a constant desired tension in the tape as it is fed to the sewing machine. Upon the depletion of a roll of tape, the reduction of tension stops the drive of the tables to enable an operator to splice the end of the tape from the next lower roll thereon, so that the sewing operation may be continued.

In order that the invention will be more clearly understood, it will now be described in detail with reference to the accompanying drawings, wherein.

Figure 9:
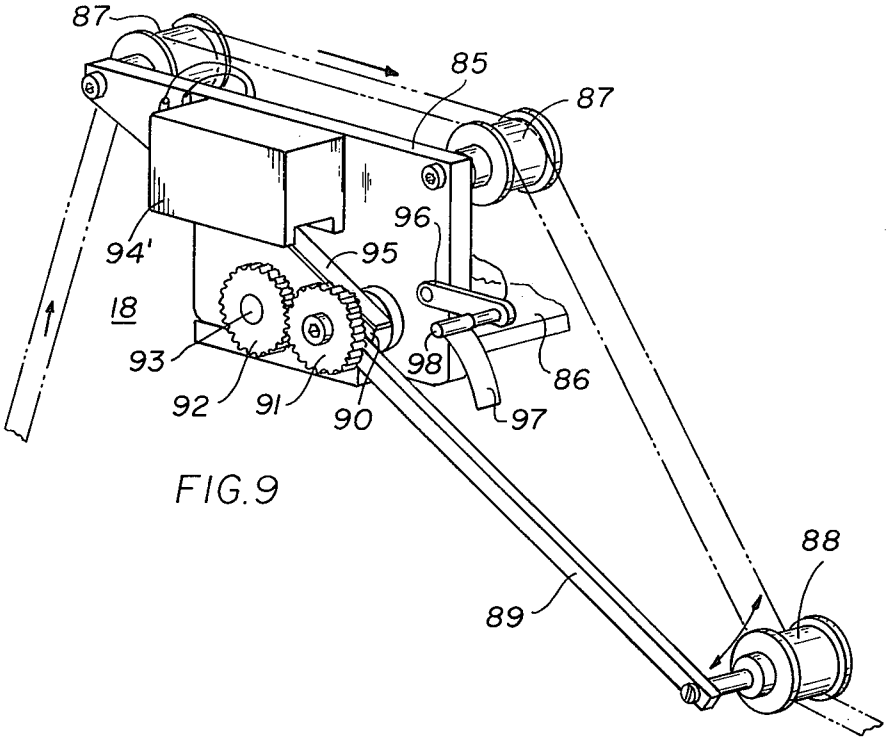
FIG. 9 is an enlarged perspective view taken from one side of the tape-sensing device shown in FIG. 7.
Figure 9A:
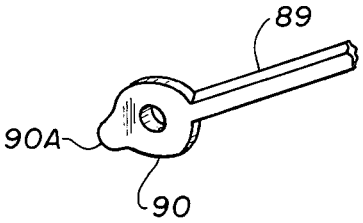

FIG. 9*a* is a view of a detail of FIG. 9; and

Figure 7:
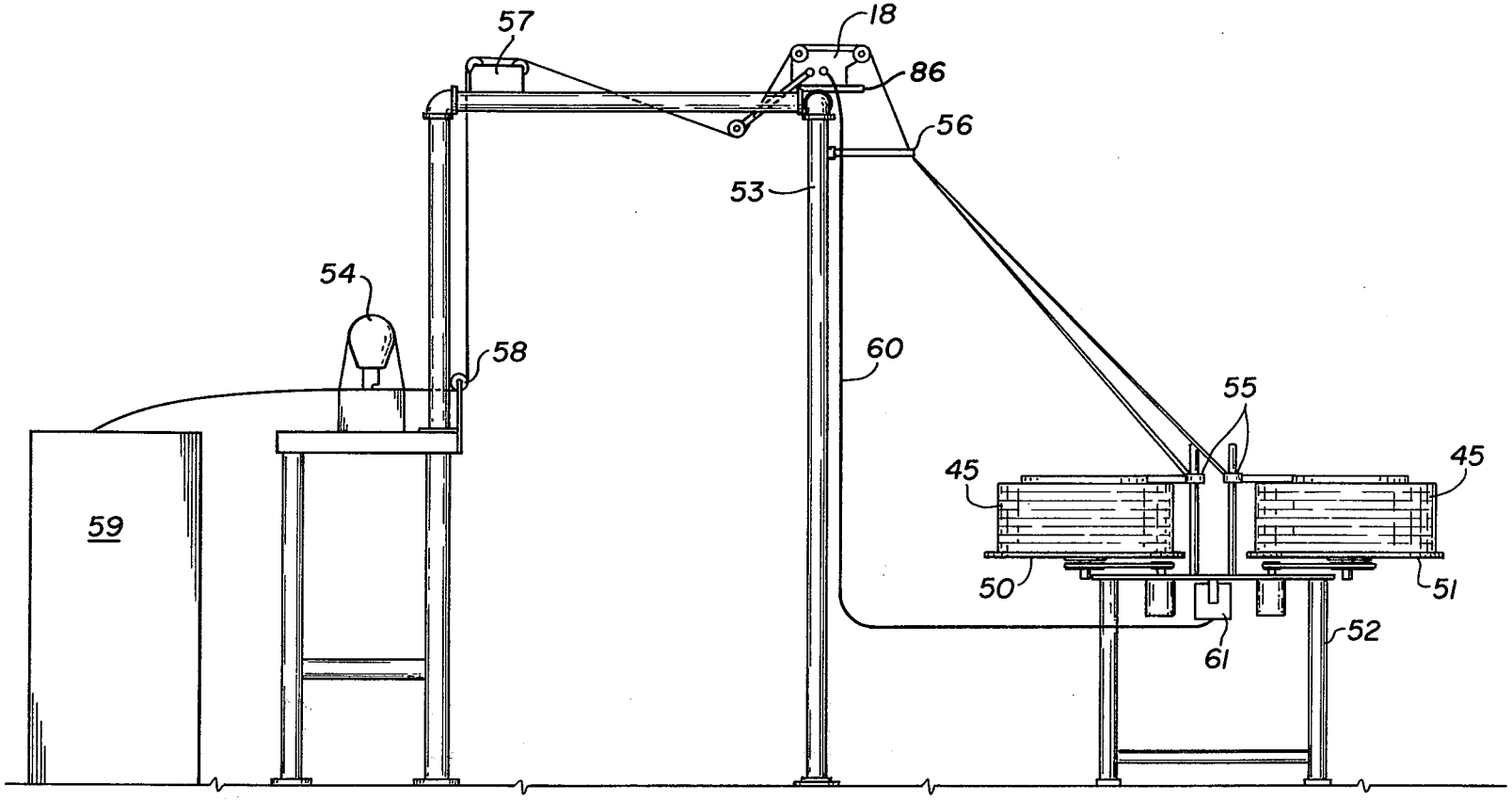
FIG. 7 is a simplified illustration of an apparatus for feeding tape from rolls produced in accordance with the invention to a sewing machine, for example, for the production of zippers.
Figure 10:
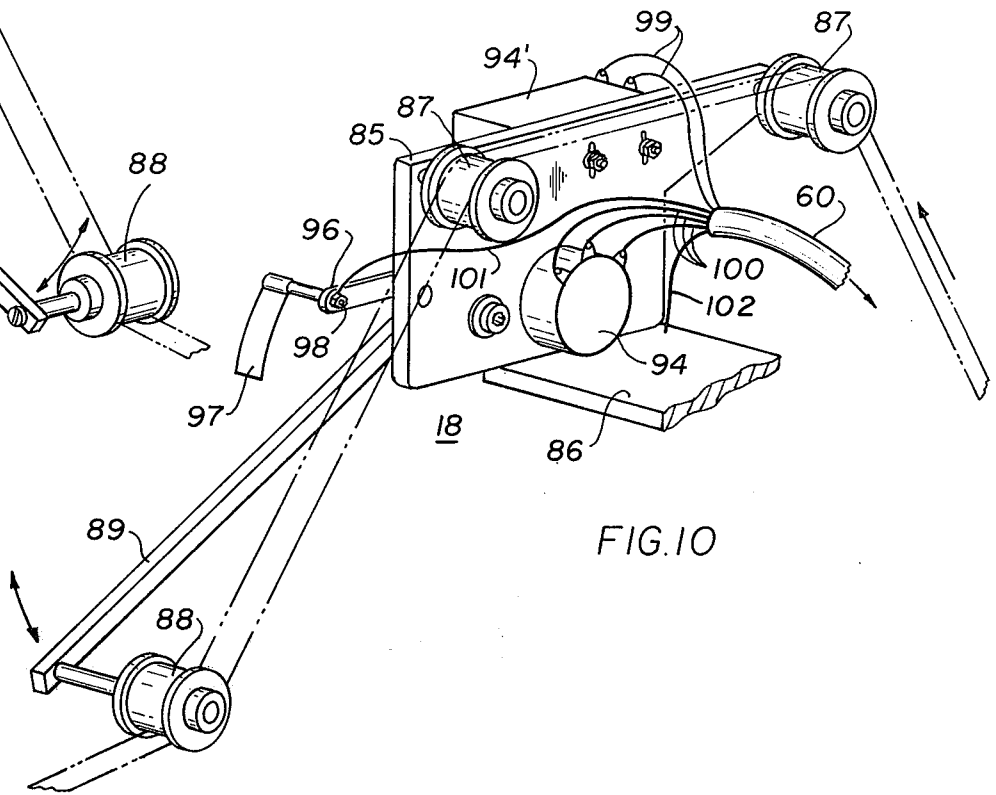

FIG. 10 is an enlarged perspective view taken from the other side of the tape-sensing device of FIG. 7.

Figure 1:
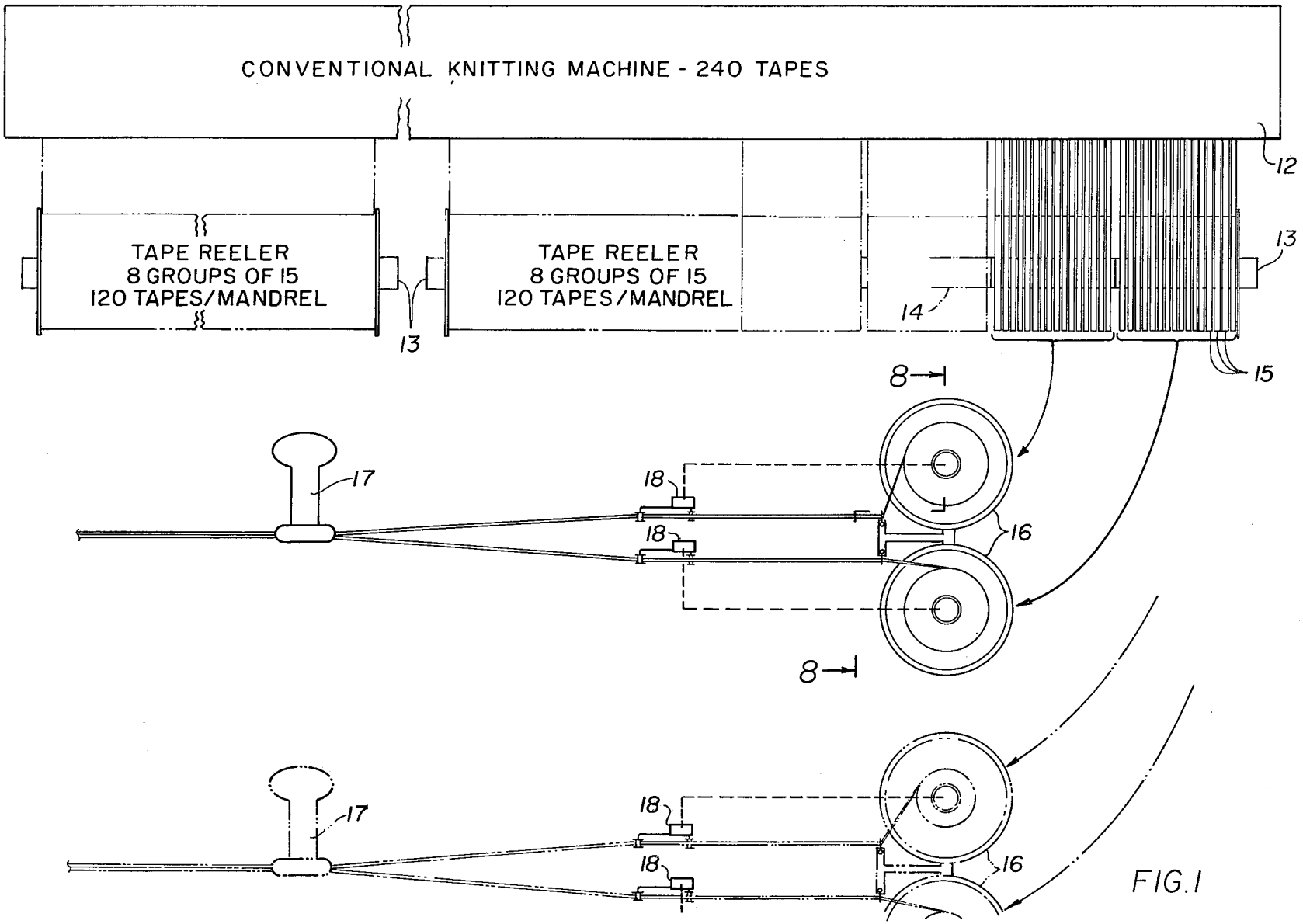
FIG. 1 is a simplified illustration of a process in accordance with the invention for feeding tapes from a conventional knitting machine to a sewing machine.

Referring now to the drawings, FIG. 1 illustrates in simplified form a conventional knitting machine 12 set up for the simultaneous production of 240 tapes. For the sake of convenience, two mandrels 13 are provided, each of the mandrels supporting eight winding cylinders 14, whereby fifteen rolls of tape 15 are wound on each winding cylinder. The mandrels 13 are removable from the centers of the winding cylinders in order to enable separation of the winding cylinders 14. The number of winding cylinders and the number of rolls of tape wound on a given winding cylinder are arbitrary, and has been selected from the standpoint that a winding cylinder with rolls of tape fully wound thereon should be light enough so that it can be handled easily by operating personnel.

In the arrangement illustrated in FIG. 1, it is apparent that the rolls of tape on each winding cylinder are spaced apart so that they are not laterally supported. A somewhat larger space may appear between the end roll of tape on one cylinder and the end roll on the adjacent cylinder, this increase in spacing being only for the sake of convenience in the separation of the cylinders. Two mandrels are employed, so that personnel operating the machine can readily remove the mandrels from the winding cylinders.

Following the winding of the rolls of tape on the winding cylinders, as illustrated in FIG. 1, the mandrels 13 are removed, slotted discs, not illustrated in FIG. 1, are inserted between the rolls on the winding cylinders, and the winding cylinders are placed with vertical axes on pairs of tables 16. The tables 16 are motor-driven and the end of the tape of the top roll on each table is fed by way of suitable guides to a sewing machine 17 for the production of zippers or the like. A tension-sensing device 18 is mounted to sense the tension of each tape as it proceeds from the winding cylinders to the sewing machine, and the speed of the motor driving the associated table is controlled in response to tension of the tape. Upon the depletion of any roll of tape from a winding cylinder, the tension of the corresponding tape changes, and this tension change is sensed by devices 18 to effect the stopping of the corresponding table as well as the table rotating in conjunction therewith in the feeding of a single sewing machine.

In the arrangement illustrated in FIG. 1, the winding cylinders 14 may conventionally be cardboard cylinders of a length of about 10 inches, the group of winding cylinders 14 on a common mandrel being firmly held together on the mandrel, for example, by the use of suitable removable collars (not shown) on the mandrel. The mandrels 13 may be aluminum mandrels in order to reduce their weight. In one example, with cardboard cylinder lengths of 10 inches, and fifteen rolls of tape wound on each cylinder, each roll was wound to have about five hundred yards of tape. The resulting package of the cardboard cylinder and its fifteen rolls of tape weighed about forty pounds. While more tape can be wound on each roll, a limit of about five hundred yards was set in this example in order to provide a weight for the package that can be readily handled by operating personnel.

Figures 2, 6:
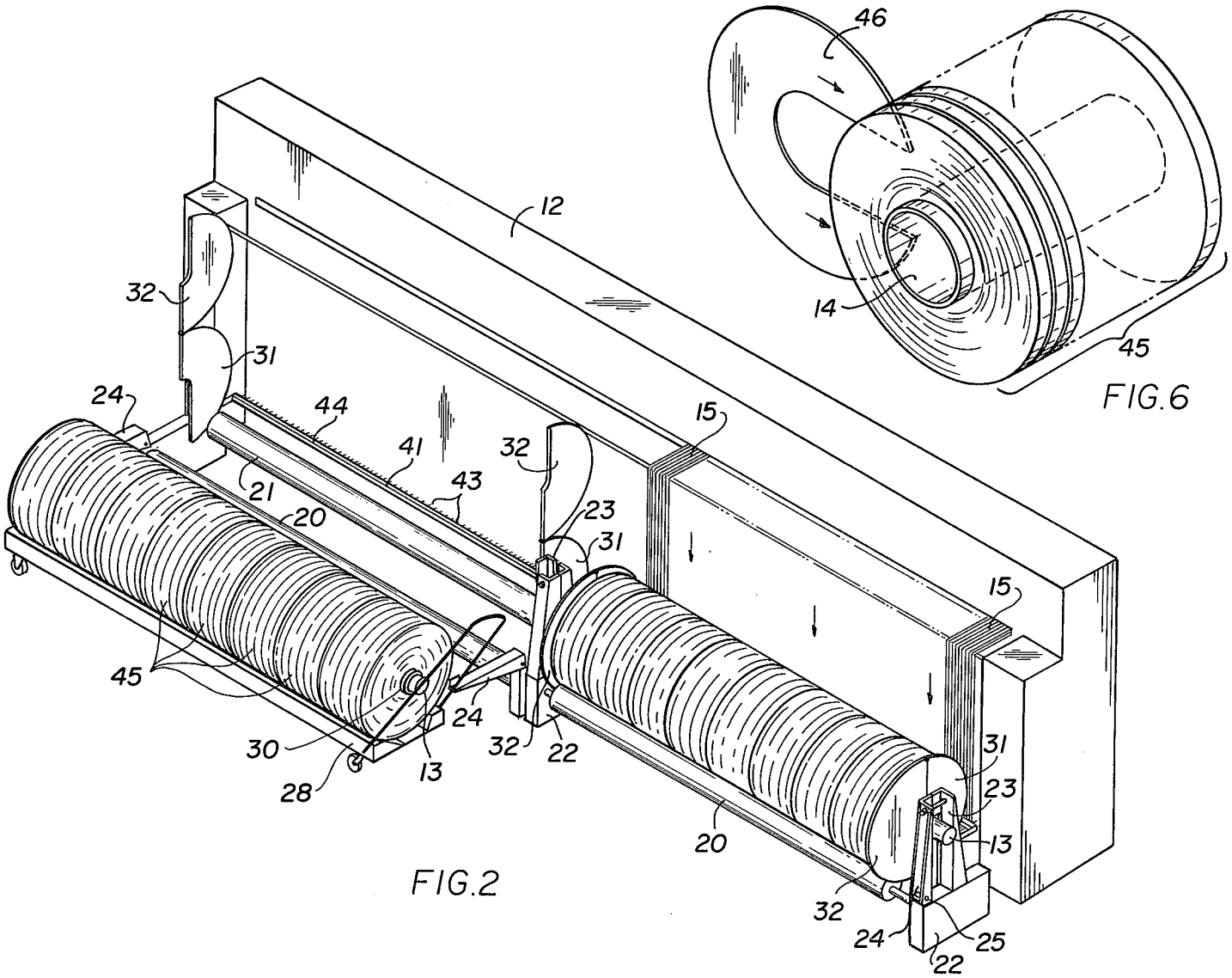
FIG. 2 is a simplified perspective view of a knitting machine showing the production of rolls of tape in accordance with the invention.
FIG. 6 is a perspective view of a cylinder wound with a plurality of rolls of tape in accordance with the invention, and further illustrating the insertion of spacing discs between the rolls of wound tape.

FIG. 2 illustrates the reeling device for the knitting machine 12 in somewhat greater detail. The reeling device is conventional in most of its features, and is comprised of a pair of horizontal spaced-apart parallel rollers 20, 21 for each bank of the apparatus. As explained above, two mandrels are employed in the illustrated embodiment of the invention, in order to facilitate the operation of the apparatus when a very large number of tapes is to be wound. It will, of course, be apparent that, depending on the size of the knitting machine, only one pair of rollers 20, 21 and an associated mandrel may be employed, or more than two groups of these elements may be employed. The rollers 20, 21 are driven by any convenient conventional means.

The driven rollers 20, 21 are mounted for rotation in end frames 22, the frames being mounted in a position whereby the rollers 20, 21 extend parallel to the output end of the knitting machine 12. A pair of parallel guides 23, 24 is provided on the frame 22 at each end of each group of driven rollers, the guide members 24 away from the knitting machine being hinged to the frame for rotation about axes 25. As more clearly appears in FIG. 3, the guide members 23 and 24 have spaced-apart vertically extending guide surfaces 26, in order to vertically guide the ends of a mandrel positioned in the reeling device. During a reeling operation, the upper ends of the guide members 23, 24 may be held together, for example, by means of a bolt 27. When the rolls of tape are fully wound, the bolts 27 may be removed and the front guide members 24 may be hinged downwardly, as illustrated at the left bank of the apparatus in FIG. 2, to enable the rolling of the wound tapes onto a suitable cart 28 for further processing. Following the loading of the wound tapes on the cart 28, the mandrel 13 may be removed from the centers of the wound cylinders, thereby facilitating the separation of the wound cylinders. In order to firmly hold the cylinders on the mandrel during the reeling operation, suitable collars 30 may be removably fitted over the mandrel 13, so that the winding cylinders are tightly pressed together during the winding operation.

During the winding operation it is desirable to provide lateral support for the endmost rolls on each mandrel, in order to inhibit collapse of these rolls and the consequent down-time of the apparatus which would result from such collapse of the end rolls. For this purpose, a fixed D-shaped plate 31 is affixed to the frame at each guide member and a further D-shaped plate 32 is hinged to each fixed D-shaped plate 31, whereby as illustrated in the right bank of FIG. 2, in closed position the D-shaped plates form a lateral support for the endmost rolls. As illustrated in the right bank of FIG. 2, the hinged D-shaped plates 32 may be swung upwardly following a reeling operation in order to enable the wound rolls to be rolled from the reeling apparatus.

The above described portion of the reeling apparatus is conventional, and hence further detailed description of the equipment is believed unnecessary.

In operation of the equipment in accordance with the invention, a plurality of winding cylinders 14, as illustrated in FIG. 1, are placed over a mandrel 13 and the winding cylinders are clamped together at each end of the mandrel by suitable means, such as collars 30. The assembled mandrel and winding cylinders are then placed on top of the driving rollers 20, 21, and the front guide members 24 are pivoted upwardly and bolted through the rear guide members 23, to form the vertical guide channel therebetween for the ends of the mandrel. The D-shaped members 32 are hinged downwardly and fixed in position by suitable conventional means, to form the lateral guide surfaces for the end rolls. It is to be noted that the D-shaped members 31 and 32 are shaped with a central clearance slot to permit vertical movement of the mandrel.

The individual tapes from the knitting machine are then manually fixed at spaced-apart positions to the winding cylinders 14. Thus, as illustrated more clearly in FIG. 3, tapes from the machine as indicated by the arrow 35, are directed downwardly and under the driven roller 21 closest to the knitting machine, thence under the driven roller 20 farthest from the machine, thence upwardly over the top of the two driven rollers 20 and 21 in that order, and thence onto the winding cylinder. Several means such as adhesive tapes may be employed to affix the knitted tapes to the winding cylinders in the desired position.

Figure 5:
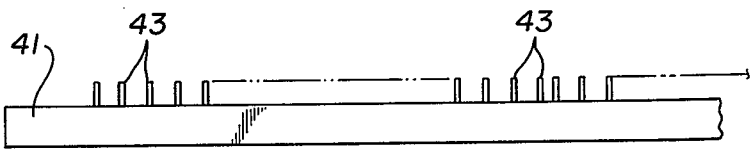
FIG. 5 is a cross sectional view of the spacing arrangement for the apparatus of FIG. 3 taken along the line 5—5 of FIG. 3.
Figure 3:
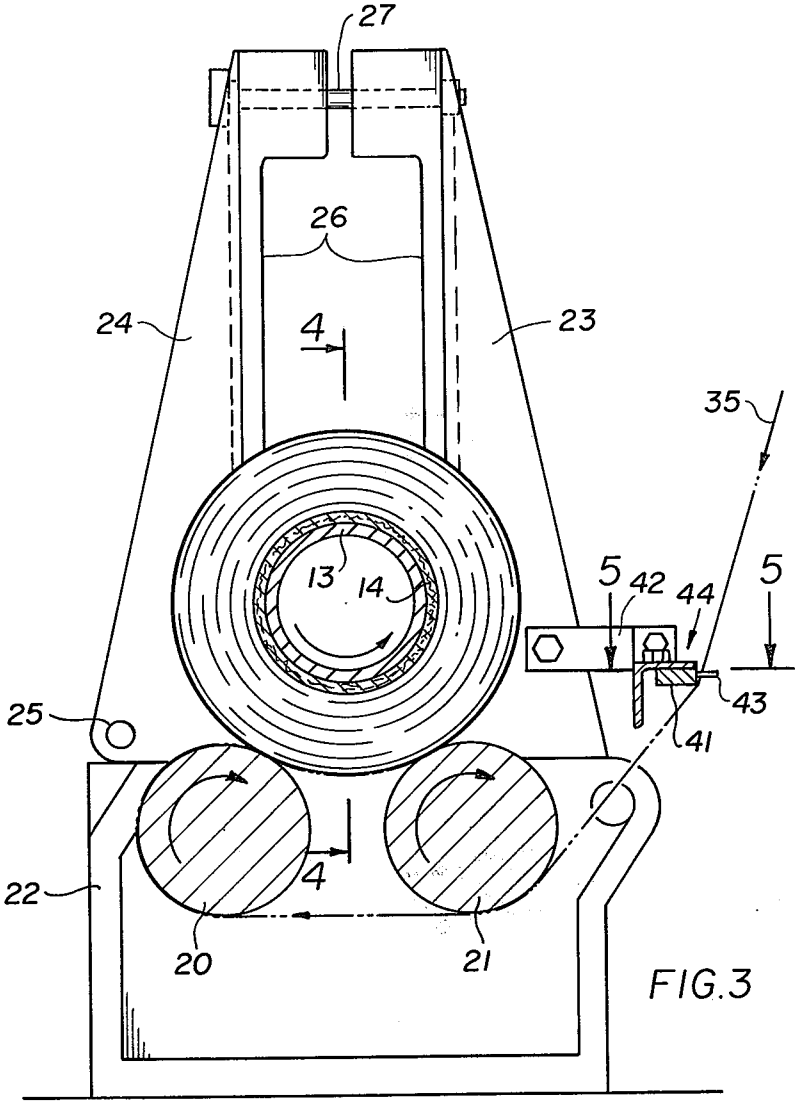
FIG. 3 is an end view of the winding mechanism of the apparatus of FIG. 2, and illustrating a modification in accordance with the invention for the reeling of spaced-apart rolls of a tape.

In order to facilitate the setup of the apparatus in accordance with the invention the reeling device is provided with a spacing device 44 automatically positioning and spacing the tapes. As illustrated in FIGS. 2 and 3, the spacing device may be comprised of a horizontal bar 41 rigidly affixed to the reeling device on the side thereof toward the knitting machine. For example, as seen in FIG. 3, the horizontal bar 41 may be rigidly affixed to brackets 42 extending from the vertical guide member 23. It will be apparent, of course, that any other conventional means may be employed for rigidly mounting the bar 41. A plurality of pins 43, as illustrated in FIGS. 2, 3 and 5, are provided extending from the bar 41 toward the knitting machine. The pins are spaced apart by distances corresponding to the widths of the tape knit on the knitting machine 12, and the pins have widths equal to the desired space between adjacent rolls of tape to be wound. If desired the pins 43 may be adjustably positioned on the bar 41 by any conventional technique, although it is preferred that they be rigidly affixed thereto, so that the entire assembly may be replaced in order to set up the apparatus for the winding of the tapes according to different dimensions.

As more clearly shown in FIG. 3, the individual tapes from the knitting machine are directed to pass through the spaces between the pins 43 before passing under the roller 21, so that the tapes will automatically be fed to the reeling apparatus in the desired spaced-apart relationship.

As discussed above, in the setup of the machine, the tapes must be aligned manually on the winding cylinders and affixed thereto. In a typical operation, in the setup of an apparatus for winding 240 rolls of tape, it has taken two men about 15 minutes to align the tapes and affix them in the winding cylinder, assuming that the pins 43 have been previously aligned. While the setup of the machine may be somewhat slower than by prior art techniques, it is to be noted that more tape can be wound on each roll than by prior art methods, and if each roll is to contain about five hundred yards of tape, a single setup is required for the winding of about 120,000 yards of tape.

Following the above setup of the apparatus, the rolls of tape are wound with tape from the knitting machine by rotating the driven rollers 20, 21 in accordance with conventional practice. Thus, as illustrated in FIG. 3, clockwise rotation of the driven rollers (i.e., the tops of the rollers proceeding toward the knitting machine) results in the imparting of a counterclockwise rotation of the mandrel and winding rollers due to frictional contact between the uppermost layers of the tape and the driven rollers 20, 21. It is to be particularly noted that, since the rolls of tape are spaced apart as they are wound, they are not provided with lateral support, and that no stitching or other support is provided between the rolls as they are being wound. In other words, the rolls of tape are wound in free-standing condition, except, perhaps, for the lateral support provided the outermost rolls by the D-shaped plates 31, 32.

Following the winding of the rolls, the ends of the tape are severed. If desired, in order to prevent unravelling of the rolls of tape, a strip of adhesive tape may be temporarily attached to the outermost layers of tape on the rolls, for example, extending across the rolls in the axial direction thereof. As discussed above, following the winding of the rolls of tape, the guide members 24 are hinged forwardly, and the D-shaped plates 32 are hinged upwardly, to permit the rolling of the mandrel with its winding cylinders and rolls of tape onto a suitable cart 28 or the like. The restraining means for the winding cylinders, such as the collars 30, may then be removed, and the mandrel 13 manually removed from the centers of the winding cylinders, so that the packages 45 of a plurality of rolls of tape each on a common winder cylinder may be separated for further handling.

Figure 4:
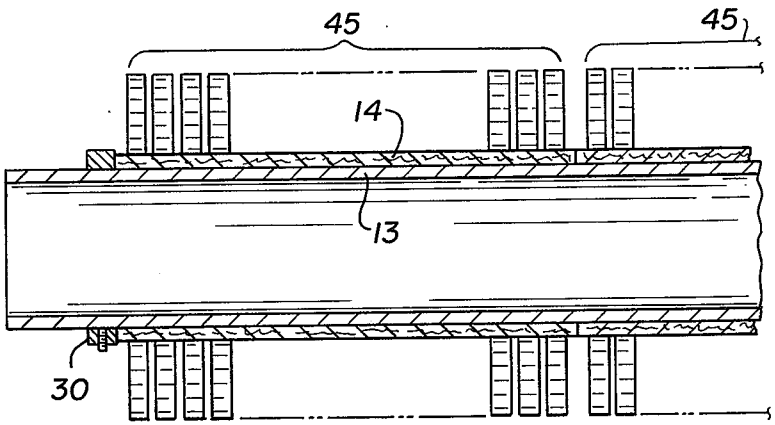
FIG. 4 is a cross sectional view of a portion of the arrangement of FIG. 3 taken along the line 4—4.

FIG. 4 illustrates a cross sectional view of a portion of the mandrel and winding cylinders with tapes wound thereon, following completion of a reeling operation. This figure illustrates the lateral spacing between the rolls of tape. As an example, the rolls of tape on a winding cylinder may be spaced apart from about 1/16 inches to ¼ inches, although this range is not critical as long as adequate space is provided for the later insertion of a disc between the adjacent rolls.

Following the winding of the rolls, as illustrated in FIG. 6, a slotted disc 46 is inserted between each pair of adjacent rolls on a winding cylinder. The slotted discs 46 may conveniently be of cardboard, having a radially extending slot of a width substantially equal to the diameter of the winding cylinder, with the diameter of the discs 46 preferably being slightly greater than the diameters of the rolls of tape. In the preferred embodiment of the invention, the slotted discs are inserted between the wound rolls of tape following their removal from the cart 28 or the like, although it will be apparent that the discs may be manually inserted at an earlier time following the completion of the winding operation. If the packages 45 of tape are to be stored prior to further use, it may be desirable to extend a cord or the like through the winding cylinder and tie it around the outside of the package, in order to avoid undesirable ravelling of the tape.

While the above disclosed portion of the method in accordance with the present invention appears relatively simple, it is based upon the heretofore unrecognized concept that narrow tapes may be successfully wound without lateral support such as stitching between the rolls of tape, and that substantial advantages are thereby derived, for example, in the reduction of storage space, the reduction of time required for handling the tape, as well as in the facilitation in the use of tape in further processing steps.

Referring now to FIG. 7, therein is illustrated an arrangement for employing the tape of tape packages 45 in the production of zippers. The apparatus is comprised of a pair of tables 50, 51 rotatably supported on a suitable support 52.

A separate tension-sensing device 18, mounted on a suitable frame 53, is provided for sensing the tension of each tape fed from a package 45 to a conventional zipper sewing machine 54. Suitable guides are provided for directing the tape from the tape packages 45 on the tables 50, 51 to the sewing machine 54 by way of the sensing devices 18, such as guides 55 mounted on frame 52 to direct tape from the tape packages upwardly to the sensing device, guides 56 on the frame 53 for further directing the tapes to these sensing devices 18, and guides 57 and 58 for directing the tapes from the sensing devices to the sewing machine 54. Completed zippers from the sewing machine 54 may be fed to a suitable container 59. As will be explained in greater detail in the following paragraphs, a control cable 60 extends between the sensing devices 18 and a motor controller 61 for the control of the rotation of the tables 50, 51.

Figure 8:
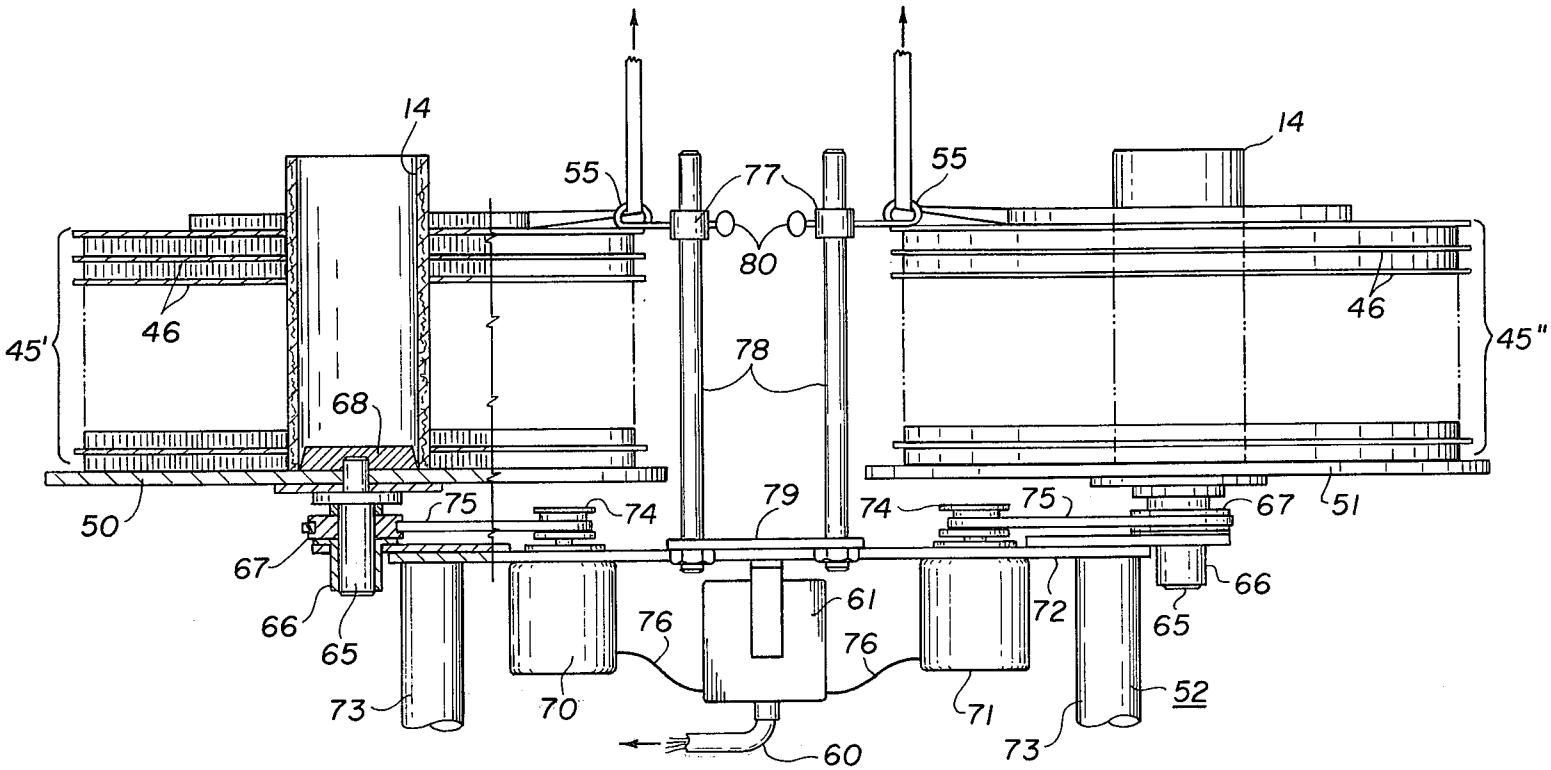
FIG. 8 is an enlarged partially cross sectional side view of the rotatable tables for dereeling the tape, taken along the line 8—8 of FIG. 1.

The rotating table assembly is more completely illustrated in FIG. 8, wherein the table 50 and a package 45′ of tape placed thereon is illustrated in cross section, while the table 51 and a package 45″ of tape placed thereon is illustrated in full side view. The tables 50 and 51 are horizontal, and are provided with downwardly extending coaxial shafts 65 journalled for rotation in bearings 66 mounted to the frame 52. A pulley 67 is provided on each shaft 65 above the bearing 66, and the pulleys 67 may serve as thrust bearings for the shafts 65. A central block 68 is provided on the top of each table for fitting into the central aperture of the winding cylinders of the packages 45′ and 45″, so that these packages will be generally coaxially aligned with their respective tables. The packages 45′ and 45″ may therefore be readily placed on the table and aligned therewith, and depleted winding cylinders may be readily removed from the tables.

A separate motor 70, 71 is provided for each of the tables 50, 51 respectively, the motors 70, 71 being mounted to the frame 52, for example, to a horizontal plate 72 extending to the vertical posts 73 which form the frame. In the illustrated embodiment of the invention, the shafts of the motors 70, 71 extend upwardly through the plate 72, and are provided at their upper ends with pulleys 74. A conventional driving belt 75 is provided extending between each pulley 74 and the associated pulley 67 to effect the separate control of the rotation of the tables 50, 51. A motor controller 61 is also mounted to the frame 52, with control leads 76 extending between the motor controllers 61 and the motors 70 and 71.

As further illustrated in FIG. 8, the tape guides 55 may be comprised of wire loops extending from collars 77 adjustably affixed to vertical rods 78 extending upwardly from a plate 79 affixed to the plate 72 of the frame 52. The collars 77 are provided with conventional clamping screws 80, in order that their position may be adjusted. Thus, the guides 55 may be adjusted so that, when dereeling any roll of tape of the packages 45′ and 45″, the guides may be positioned to guide the tape generally horizontally from each roll and hence upwardly as indicated by the arrows. Such positioning of the guides thereby inhibits twisting of the tape.

Referring now to FIGS. 9 and 10, the tension-sensing devices 18 are comprised of vertical mounting plates 85 affixed to a horizontal base plate 86. Thus, in the production of zippers and the like where two courses of tape are required, two vertical mounting plates 85 may be mounted on a common base plate 86, the base plate 86 being mounted on the frame 53 as illustrated in FIG. 7.

A pair of rollers 87 are mounted in spaced-apart relationship at the upper portions of the plate 85, and a further roller 88 is affixed to the end of a dancer arm 89 pivoted to the plate 85. As illustrated in FIGS. 9 and 10, tape from the rotating tables proceeds upwardly to the rollers 87, the two rollers 87 thence directing the tape generally horizontally. From the rollers 87, the tape proceeds downwardly and under the roller 88 on the dancer arm, the tape thence proceeding by way of further guiding devices to the sewing machine. It is thus apparent that increasing tension of the tape results in upwardly directed forces on the roller 88, and hence upward movement of the dancer arm 89.

The dancer arm is affixed to a cam 90 rotatably mounted to the plate 85, and a gear 91 is mounted for rotation with the cam 90. A further gear 92 meshes with the gear 91, and is affixed to the shaft 93 of a potentiometer 94. A microswitch 94′ is also mounted to the plate 85, the actuating leaf 95 of the microswitch extending into contact with the cam 90. In addition, an insulating bracket 96 is provided extending from the plate 85, and a leaf contact 97 is mounted on the bracket 96 to be insulated from the plate 85, for example, by means of mounting screw 98. As is apparent in FIG. 10, the leads 99 from the microswitch, the leads 100 from the potentiometer, a lead 101 from the screw 98, and a lead 102 grounded to the frame 85 are directed to the cable 60 connected to the motor controller 61 shown in FIGS. 7 and 8.

In a normal dereeling operation, the tension of the tape provides a vertical force on the end of the dancer arm 89, acting against the weight of this arm, so that the shaft of the potentiometer is positioned in accordance with the tension of the tape. The motor controller 61 is of conventional nature, and controls the speeds of the two motors to maintain a determined tension in the tape in response to the position of the shafts of the potentiometers of the respective tension-sensing devices. In other words, each motor is controlled to rotate its respective table in order to maintain a desired tension in the tape fed from that table.

When the tape from a roll of tape being dereeled is depleted, the inner end of the tape will generally be held to the winding cylinder, since it was fixed thereto during the above described setup operation, and as a result the tension of the tape will increase. This will result in the upward movement of the dancer arm until it contacts the contact leaf 97, whereby a connection is made between the conductor 101 and the grounded lead 102. This connection effects the stopping of both of the motors connected to the motor controller 61, by conventional means, so that an operator may then proceed to splice the end of the depleted roll of tape to the outer end of the next roll of tape in the tape package. At such time, the operator, of course, removes the slotted disc from the top of the next roll to be dereeled, and adjusts the guide 55 to correctly feed the tape from the next roll.

In the event that a tape breaks during dereeling of a roll, or if the end of the tape is released from the winding cylinder prior to contacting of the contact leaf 97, it is also desired to stop both of the motors. In this case, the tension of the tape passing through a sensing device is greatly reduced, resulting in the dropping of the dancer arm 89 and the rotating of the cam 90. The cam 90 is fixed to actuate the microswitch 94' with cam lobe 90A in response to such dropping of the arm, and hence the motor controller 61 is again controlled to stop the rotation of the two motors. It will be apparent, of course, that other equivalent arrangements will be provided for the sensing device 18.

In the setup of the dereeling device in accordance with the invention, the tape packages on the winding cylinders as above described are placed with vertical axes on the rotating tables 50, 51, and the outer end of the tape on the upper roll of each package is fed through the guides 55 and 56, around the rollers of separate sensing devices 18, and thence to the sewing machine 54 by way of the guides 57 and 58. It is understood, of course, that the number and placement of the guides is variable depending on the placement of the components of the system. Thus, as in the arrangement of FIG. 7, the tape is guided from a high level behind the sewing machines in order to free this space from obstructions. The dereeling apparatus thus maintains the desired tension in the tape as it is fed to the sewing machines, without risking entanglement of the tapes as has been heretofore experienced in the use of boxes containing tapes in loose form. Since the tape in the packages on the rotating tables is in compact form, the sewing machines may be operated for a considerably greater length of time without splicing than was possible when loose boxes of tape were employed, and the sewing machines may be operated for a considerably greater length of time before replacement of the tape packages is required. This results in considerable saving in time and effort in the production of zippers or the like.

It is, of course, apparent that the method and apparatuses above described in accordance with the invention may be employed advantageously for other uses of tape than in the production of zippers.

While the tapes, in principle, could be fed to the sewing machines from the packages of tape on freely rotatable tables, by way of conventional tension devices, this technique introduces problems since the weight of the supply of tape on the tables varies considerably from the start of the first roll to the end of the last roll, and hence it is difficult to control the tension of the tape properly by such means. By providing a separate motor for rotating each of the tables, however, and controlling the speed of rotation as a function of the tension of the tapes, a reliable constant tension in the tapes fed to the sewing machine is provided. Thus, the arrangement of the present invention requires no further tensioning apparatus in the feed of the tape to the sewing machines.

While the invention has been disclosed and described with reference to a single embodiment thereof, it will be apparent that variations and modifications may be made therein, and it is intended in the following claims to cover each such variation and modification that falls within the true spirit and scope of the invention.

What is claimed is:

1. In a method for producing zippers of the type including the steps of producing tapes for the zippers on a knitting or weaving machine and feeding a pair of such tapes to a sewing machine for the production of zippers, the improvement comprising producing a pair of packages of tape each comprised of a roll of narrow tape, placing said packages with vertical axes on separate rotatable tables, directing tape from each of said rolls to said sewing machine, separately sensing the tension of each tape extending between a roll and said sewing machine, and positively rotating said tables to maintain the tension in the respective tape substantially constant.

2. The method of claim 1 further comprising stopping said positive rotation of both of said tables in response to the sensing of tension in either of said tapes that is below a predetermined minimum value or above a predetermined maximum value.

3. The method of claim 1 wherein said step of producing a pair of packages of tape comprises winding a plurality of spaced-apart free-standing rolls of tape directly from said knitting or weaving machine onto each of a pair of winding cylinders, and inserting discs between adjacent rolls of tape on each of said winding cylinders to produce said packages, said step of directing tape from each of said rolls comprising directing tape from the uppermost roll of each package to said sewing machine, and further comprising, upon depletion of any roll of tape on a winding cylinder, removing the disc below the respective depleted roll and splicing the trailing end of said depleted roll onto the outermost end of the next lowermost roll on the same winding cylinder.

4. In the method of producing articles from narrow tapes wherein tape produced on a knitting or a weaving machine is applied to a utilization device, the improvement comprising directly winding a plurality of narrow tapes from said knitting or weaving machine onto a winding cylinder to form a plurality of spaced-apart free-standing rolls of tape, inserting discs between adjacent rolls of tape on said winding cylinder, placing said winding cylinder on a rotatable table, with the axis of said winding cylinder and the axis of rotation of said table extending vertically, directing tape from the radially outer end of the uppermost roll on said winding cylinder to said device, sensing the tension of tape extending from said roll to said device, positively rotating said table to maintain a substantially constant tension in the tape directed from a roll of tape to said device, and splicing the trailing end of a roll of tape, upon depletion thereof, to the radially outermost end of the next roll of tape on said winding cylinder.

5. An apparatus for feeding narrow knit or woven tape from rolls of said tape to a utilization device, comprising a rotatable table having a vertical axis of rotation adapted to receive and rotate a roll of tape placed thereon, guide means for directing tape from a roll placed on said table to a given path to said utilization device, a sensing device fixably mounted adjacent said path for producing an output signal corresponding to the tension of tape extending along said path, and motor means coupled to rotate said table positively, and motor control means responsive to said signal and connected to control said motor to maintain a substantially constant tension in tapes extending along said path.

6. The apparatus of claim 5 wherein said sensing device comprises means for sensing tension in said tape below a predetermined minimum value and above a predetermined maximum value, and said motor control means comprises means for stopping said motor means in response to tension of said tape below said predetermined minimum value and above said predetermined maximum value.

7. The apparatus of claim 6 wherein said utilization, devices comprises a sewing machine for the production of zippers, and further comprising a second rotatable table having a vertical axis of rotation for receiving and rotating a roll of tape, a second sensing device positioned in a second path extending from said second table to said sewing machine for producing an output signal in response to tension of tape extending along said second path, second variable speed motor means coupled to rotate said second table, means applying the output of said second sensing device to said motor control means, said motor control means comprising means responsive to the output signal of said second sensing device for controlling said second motor means to maintain the tension of tape in said second path substantially constant, each of said sensing devices comprising means for sensing tensions in tapes in the respective paths below a predetermined minimum value and above a predetermined maximum value, said motor control means comprising means responsive to the sensing of tension of tape in either of said paths below said minimum value and above said maximum value for stopping both of said motor means.

* * * * *